US009039491B2

(12) United States Patent
Kobayashi et al.

(10) Patent No.: US 9,039,491 B2
(45) Date of Patent: May 26, 2015

(54) MACHINE FOR BLASTING ABRASIVES

(75) Inventors: Yuji Kobayashi, Toyokawa (JP); Takeyoshi Nakata, Toyokawa (JP)

(73) Assignee: SINTOKOGIO, LTD., Nagoya-Shi, Aichi (JP)

( * ) Notice: Subject to any disclaimer, the term of this patent is extended or adjusted under 35 U.S.C. 154(b) by 402 days.

(21) Appl. No.: 13/499,355

(22) PCT Filed: Nov. 22, 2010

(86) PCT No.: PCT/JP2010/006833

§ 371 (c)(1),
(2), (4) Date: Jun. 13, 2012

(87) PCT Pub. No.: WO2011/064983

PCT Pub. Date: Jun. 3, 2011

(65) Prior Publication Data

US 2012/0252327 A1 Oct. 4, 2012

(30) Foreign Application Priority Data

Nov. 27, 2009 (JP) ..... 2009-269551
May 14, 2010 (JP) ..... 2010-112116

(51) Int. Cl.
*B24C 9/00* (2006.01)
*B24C 3/22* (2006.01)

(52) U.S. Cl.
CPC .... *B24C 9/00* (2013.01); *B24C 3/22* (2013.01)

(58) Field of Classification Search
CPC ..... B24C 9/00; B24C 3/22
USPC ..... 451/89, 451, 393, 394, 395, 398, 402
See application file for complete search history.

(56) References Cited

U.S. PATENT DOCUMENTS 5,584,747 A * 12/1996 Ikeda et al. ..... 451/83
2003/0124955 A1* 7/2003 Hanson ..... 451/2

FOREIGN PATENT DOCUMENTS

| | | |
|---|---|---|
| JP | 63-66194 | 2/1988 |
| JP | 06-000771 | 1/1994 |
| JP | 10-151566 | 6/1998 |
| JP | 2000-006028 | 1/2000 |
| JP | 2000-042928 | 2/2000 |

OTHER PUBLICATIONS

International Search Report from the European Patent Office for International Application No. PCT/JP2010/006833, mailing date Apr. 12, 2011.

* cited by examiner

*Primary Examiner* — Timothy V Eley
(74) *Attorney, Agent, or Firm* — Finnegan, Henderson, Farabow, Garrett & Dunner, L.L.P.

(57) ABSTRACT

The object of the present invention is to provide a machine for blasting abrasives that has a simple structure and that solves the problem of abrasives falling when the door for the gateway for the work is opened or closed. The machine for blasting abrasives comprises a chamber 11 for processing, a nozzle 13 that is provided within the chamber 11 for shooting the abrasives (shots) S onto the work W, and a jig 15 for holding the work W at a position facing the nozzle 13. A gateway 17 with a door 19 is formed in the ceiling 11*a* of the chamber 11. The size of the gateway 17 enables the work W to protrude from the chamber 11 by means of the jig 15 at a position corresponding to the jig 15 that is linearly moving up and down. The door 19 is provided within the chamber 11 so as to seal the gateway by linearly moving up and down and so as to create a vacant plane on the gateway for passing the work by horizontally moving.

5 Claims, 12 Drawing Sheets

(Prior Art)

(A)

(B)

MACHINE FOR BLASTING ABRASIVES

TECHNICAL FIELD

The present invention relates to a machine for blasting abrasives that is used for processing a surface of a work (an object to be processed), such as by surface modification, grinding, and burring. The machine shoots shots (abrasives) onto a work just as a machine for shot-peening or shot-blasting does.

The term "abrasives" means any materials to be shot by energy that is provided by an airflow, a fluid flow (such as a water flow), or centrifugal forces. The materials are used for processing a surface of a work such as shot blasting and shot peening. Thus, the abrasives include any materials to be shot, such as fine grains, grits, and cut wires, as well as shots (small particles).

BACKGROUND ART

FIG. 1 illustrates a schematic diagram of a prior-art machine for blasting abrasives that is used for shot blasting.

The machine for blasting abrasives comprises a nozzle (a nozzle for shooting) 113 for shooting abrasives onto a work, a jig 115 for holding the work, and a door 119 for opening and closing a gateway 117 to bring the work to be processed in and take the processed work out. The height of the jig 115 is adjustable so as to keep the work W in a position to face the nozzle 113. The jig 115 is attached to a vertically-moving pivoting table 116. Auxiliary cylinders 131 for clamping, which are disposed at the respective four corners of the door 119, enable the door 119 to tightly contact, and separate from, a surrounding sealing material 121, which is disposed along the outer rim of the gateway 117. This structure is designed to withstand a vacuum or an unexpected high pressure in a chamber for processing.

The door 119 is disposed outside a sidewall 111*b* of the chamber 111. The door 119 slides vertically or laterally (vertically in FIG. 1) along the outside of the wall by means of a cylinder 123 for opening and closing the door. See Paragraph 0002 of Japanese Patent Laid-open Publication No. 2000-6028 and FIG. 1 of Japanese Patent Laid-open Publication No. H6-771.

However, the above door has the following problems. Reference is now made to Paragraph 0002 of Japanese Patent Laid-open Publication No. 2000-6028.

"The scattered blasting materials or dust generated by processing easily adhere to the surface of the door facing the machine for shot blasting. Thus the blasting materials on the surface of the door may slide into the sealing surface to deteriorate the seal. They may fall out of the machine, to contaminate the area near the machine. These have been problems. Further, the machine for shot blasting is normally kept in a vacuum during the process to prevent the shot-blasting materials from flowing out. Thus if the door is opened during the process, a differential pressure is applied to the door. That causes a problem in the operability of the door."

To solve the problems, a device for a door for a work in a chamber for shot blasting is proposed by the prior-art publication Japanese Patent Laid-open Publication No. 2000-6028 (see claim 1).

Claim 1 says the following:

"A device for a door for a work in a chamber for shot blasting, wherein an opening for passing the work is formed in a surrounding wall of a machine for shot blasting, the machine processing the work by shooting blasting materials from a nozzle for blasting by means of a high-velocity airflow, the door being provided so that the door closes the opening by contacting the rim of the opening from the inner side of the chamber."

The door disclosed in the publication is attached to the sidewall. It swings to open and shut. Thus, when the door is opened, blasting materials (abrasives) that have adhered near the door may fall outside the chamber. Thus the following component is proposed to effectively prevent the blasting materials from adhering to the door (see claim 3 and Paragraph 0004).

"A protecting cover is provided above the opening. Auxiliary covers are provided between the side section of the protecting cover and the periphery of the machine for shot blasting. A means for supplying air under the protecting cover is provided."

The prior-art publication Japanese Patent Laid-open Publication No. H10-151566 discloses a machine for burring by shot blasting to solve the problem wherein shot materials fall outside the machine (see Paragraph 0010). In the machine a gateway for a work is formed in the ceiling of the machine. One swinging door is attached by a hinge to the rim of the gateway to open and close it. The door has tapered edges (see the abstract, claim 1, and FIGS. 1 and 3).

However, in the publication, the direction to bring the work into the machine is offset from the center of a jig 15 for holding a work (a means for mounting a basket) when the work is processed. Thus a mechanism to rotate the jig 15 is needed. Further, a first cylinder for opening and closing the door is needed on the upper surface of the door. A second cylinder that is mounted on the pivot of the door is also needed. The piston rod of the second cylinder is illustrated as penetrating the door. Therefore its structure is unclear. Thus no detailed description is given that is sufficient and clear so as to enable one having ordinary skill in the art to work the invention.

It is not denied that in Japanese Patent Laid-open Publication No. H6-771 there is "a door for bringing a work in and taking it out is provided on an upper wall in a chamber for grinding" (see the abstract and claim 1). However, it is not intended nor suggested to dispose a gateway for a work with a door on the upper wall to prevent abrasives from dropping outside the machine when opening or closing the door. Actually, in the embodiment, which should be preferable, a sliding door for the gateway is provided at the sidewall.

All of the prior-art publications described above relate to a machine for shot blasting, not to a machine for shot peening.

The object of shot peening is for the surface modification of a work. That of shot blasting is for burring, grinding, making a matte finish, polishing, or making a pearskin-finish or a leather-texture finish, of the surface of a work. Thus they are different processes.

For shot peening, shots with a diameter (e.g., 20 to 100 μm)

that is smaller than that of the blasting materials have increasingly been used to enhance the effect of shot peening. The sizes of the shots for blasting are generally in the range of 50 to 2500 μm.

Hence, the structure for sealing disclosed in Japanese Patent Laid-open Publication No. H10-151566 may not cause problems when shot blasting is carried out. However, when shot peening is carried out where fine abrasives (shots) are used, the shots may penetrate the gap between the inner surface of the gateway and the opposing outer surface of the door. Thus a problem such as a bite by the abrasives may occur there. The structure for sealing is formed as follows:

"A sealing member 47 includes an elastic portion 47*a* that is formed with silicone covered with glass wool and an attaching member 47*b* that is a portion extending from the glass wool. The attaching member 47*b* is fixed to the sidewall of a door 40 by a fixing member, such as a screw. The elastic portion 47*a* is positioned at the lower edge of the sidewall of the door 40" (see Paragraph 0035 and FIG. 5).

Furthermore, the structure for sealing the door that is disclosed in Japanese Patent Laid-open Publication No. 2000-6028 and in No. H10-151566 is complicated.

In the structure for sealing disclosed in Japanese Patent Laid-open Publication No. 2000-6028 a means for supplying air is needed as described above. In the structure for sealing disclosed in Japanese Patent Laid-open Publication No. H10-151566 it comprises a link mechanism with two pin joints. To withstand a negative pressure during a process, a robust link mechanism must be used.

DISCLOSURE OF INVENTION

The present invention has been conceived to solve the above problems. It is, therefore, an object to provide a machine for blasting abrasives with a novel and simple structure that can solve the problem wherein abrasives fall when opening and closing the door for a gateway for a work.

As a result of the inventors' intense efforts for solving these problems, the structure that is, for example, illustrated in FIGS. 2 and 3, has been conceived as the present invention. In the structure a gateway for a work is formed in the ceiling of a chamber for processing. The door for the gateway is provided on the inner side of the gateway. The door moves back and forth in a direction perpendicular to the ceiling to contact, and separate from, the ceiling. While the door separates from the ceiling it moves horizontally so as to be offset from the gateway.

A machine for blasting abrasives comprises a chamber 11 for processing, a nozzle 13 for shooting abrasives (shots) S onto a work, and a jig 15 for holding the work in the position facing the nozzle 13. The nozzle 13 is located within the chamber 11. A gateway 17 for the work that is formed in the chamber 11 is opened and closed by a door 19. The machine is characterized in that the gateway 17 is formed in the ceiling 11*a* of the chamber 11. It is also characterized in that the door 19 is provided within the chamber 11 so as to linearly move up and down to tightly contact, and separate from, the gateway 17. While the door 19 is separating from the gateway 17, it horizontally moves to create a vacant plane on the gateway 17 for passing a work.

In the above structure, it is preferable that the jig 15 linearly move up and down so as to be able to adjust the height. The gateway 17 is formed at the location corresponding to the jig 15 that is linearly moving up and down. It has such a size so as to enable the work W to protrude by means of the jig 15 from the chamber 11. Since one driving source can be used for bringing the work in and taking it out and for adjusting the height of it during the process, the structure of the machine for blasting abrasives can be simplified. Further, energy can be saved.

In the above structure, it is preferable that the door 19 be shaped as a dome (hemisphere). By doing so, any error in the size of the door 19 or the opening that is manufactured may be compensated for. A misalignment of the motion of the door 19 in relation to the gateway 17 may be also compensated for. Thus sealing by the door can be reliable and stable.

Furthermore, in the above structure, it is preferable that an auxiliary mechanism 29 for shutting the door that functions under a vacuum be provided on the chamber 11, as, for example, shown in FIG. 5. The auxiliary mechanism 29 has a plurality of cylinders 31 that are located under the periphery of the door 19. The tips of piston rods 31*a* press the periphery of the door. In the cylinder 31 a communication tube 33 that communicates with the outside of the chamber 11 is connected to the compressing chamber 31*b* that pushes out the piston rod 31*a*. A vent 35 that communicates with the inside of the chamber 11 is formed in a back-pressure chamber 31*c*. Since the pressure in the chamber 11 becomes negative during the process because of the operation of a dust collector, etc., sealing may be more reliable and stable (i.e., an increase of the pressure for sealing).

In the above structure the driving means for linearly moving the jig up and down can be combined with the driving means for linearly moving the door up and down.

In the above structure, as shown, for example, in FIGS. 9 and 10, the jig 15 is connected to a driving unit 41 for rotating the jig 15, which driving unit 41 can be vertically moved by a vertically-moving unit. The vertically-moving unit comprises a cylindrical supporting member 76 that stands under the driving unit 41 for rotating the jig on the floor of the chamber 11. It is located near one of the ends of the driving unit 41 for rotating the jig. The vertically-moving unit also comprises an extending and contracting member 77 that is disposed within the supporting member 76. It is shaped like a bellows to extend or contract by having fluid supplied to or discharged from it. The vertically-moving unit also comprises a circular disk that is suspended from the underside of the driving unit 41 for rotating the jig. The circular disk is slidably attached to the supporting member 76. It contacts the upper end of the extending and contracting member 77.

The basic Japanese patent applications, No. 2009-269551, filed Nov. 27, 2009, and No. 2010-112116, filed May 14, 2010, are hereby incorporated by reference in their entireties in the present application.

The present invention will become more fully understood from the detailed description given below. However, the detailed description and the specific embodiment are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

BEST MODE FOR CARRYING OUT THE INVENTION

Figure 1:
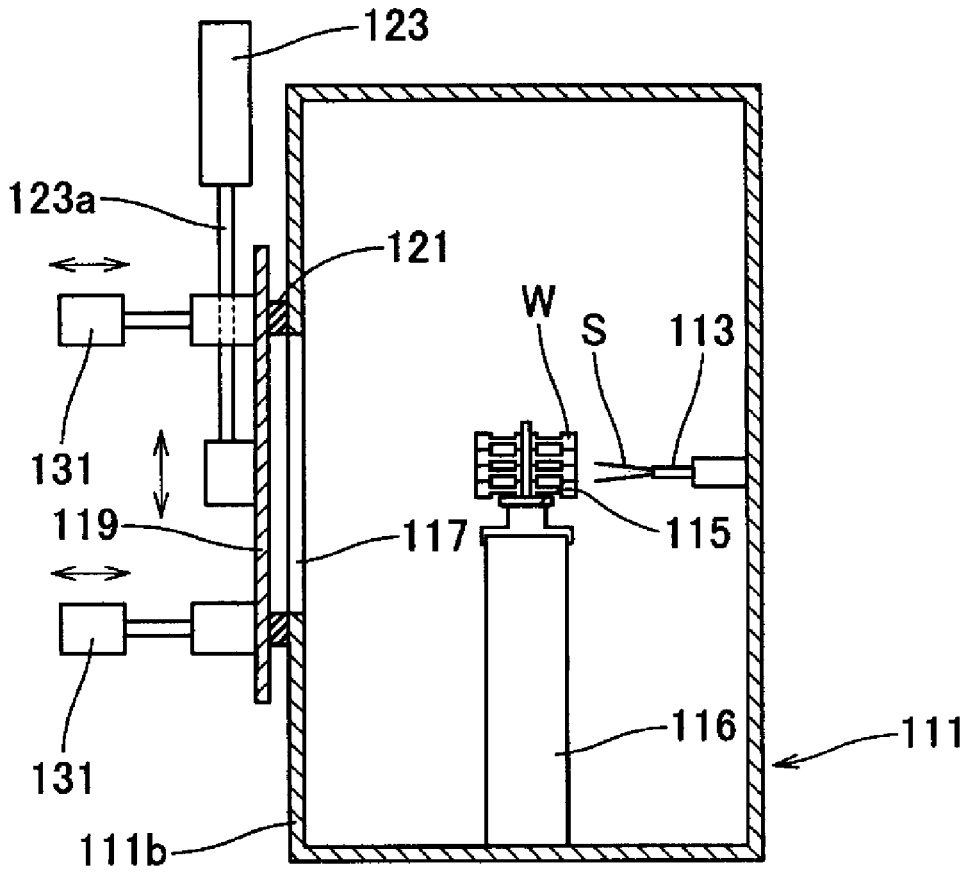
FIG. 1 shows a schematic sectional drawing of a prior-art machine for blasting abrasives (a machine for shot blasting).
Figure 2:
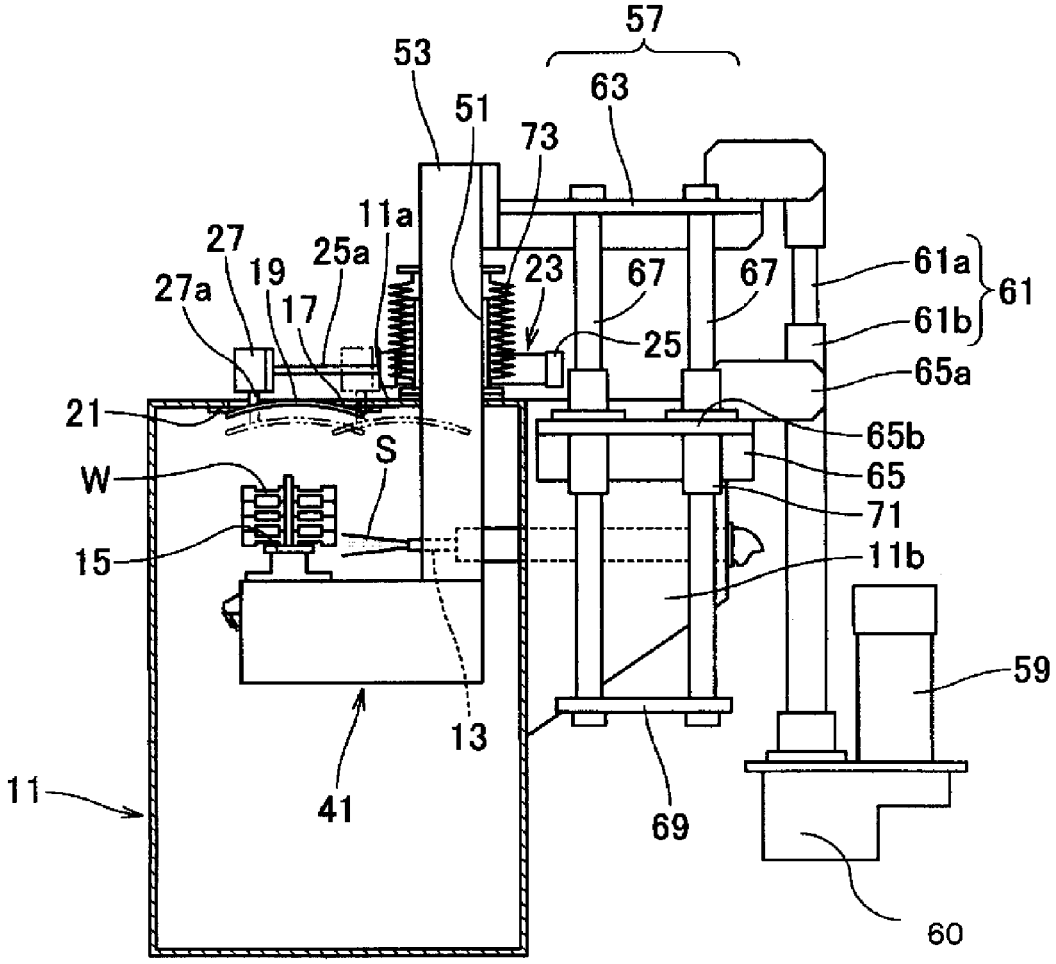
FIG. 2 illustrates a schematic sectional front view of an embodiment (a machine for shot peening) of a machine for blasting abrasives according to the present invention, when a work is processed.
Figure 3:
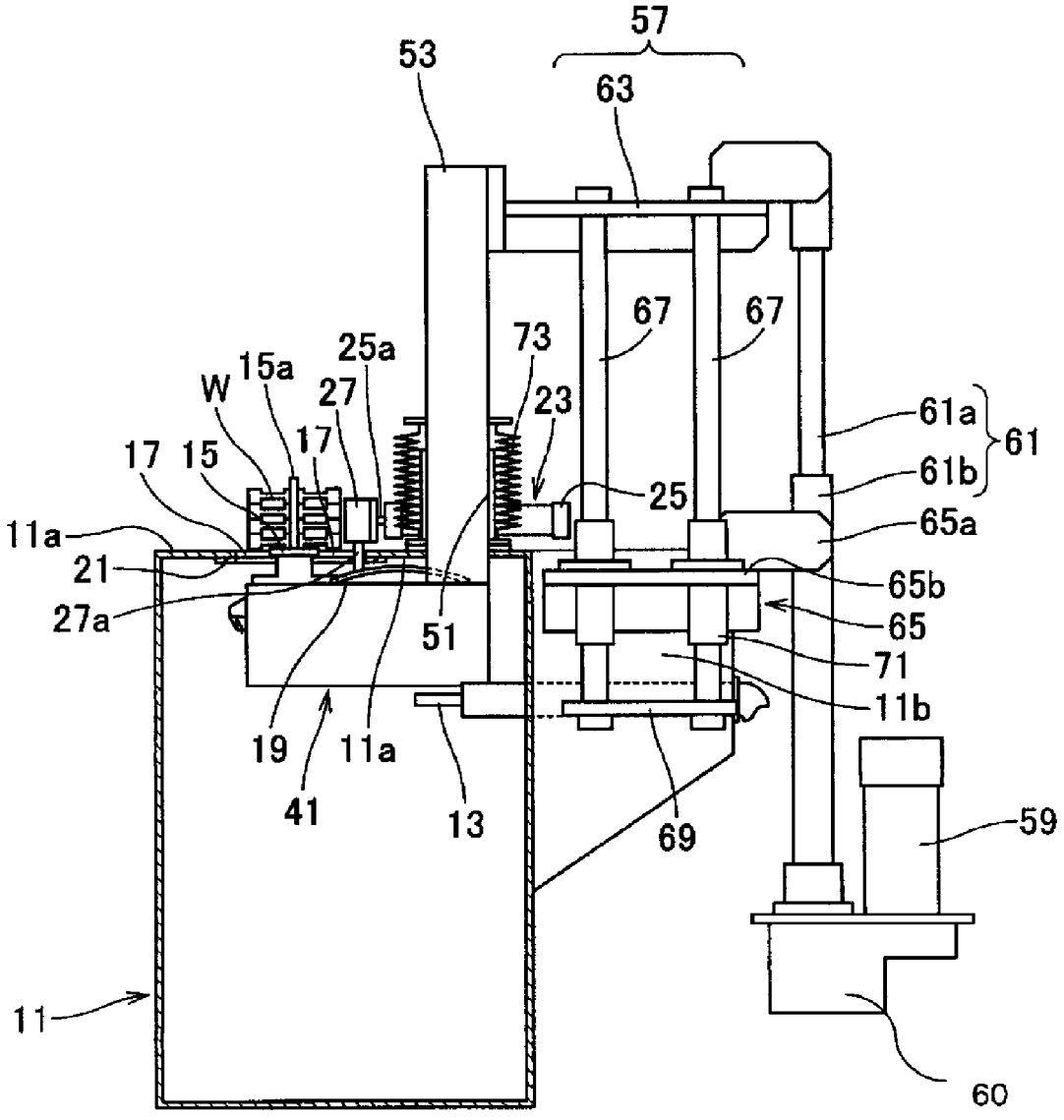
FIG. 3 illustrates the schematic sectional view of the machine for blasting the abrasives of FIG. 2, when a work is taken out.
Figure 4:
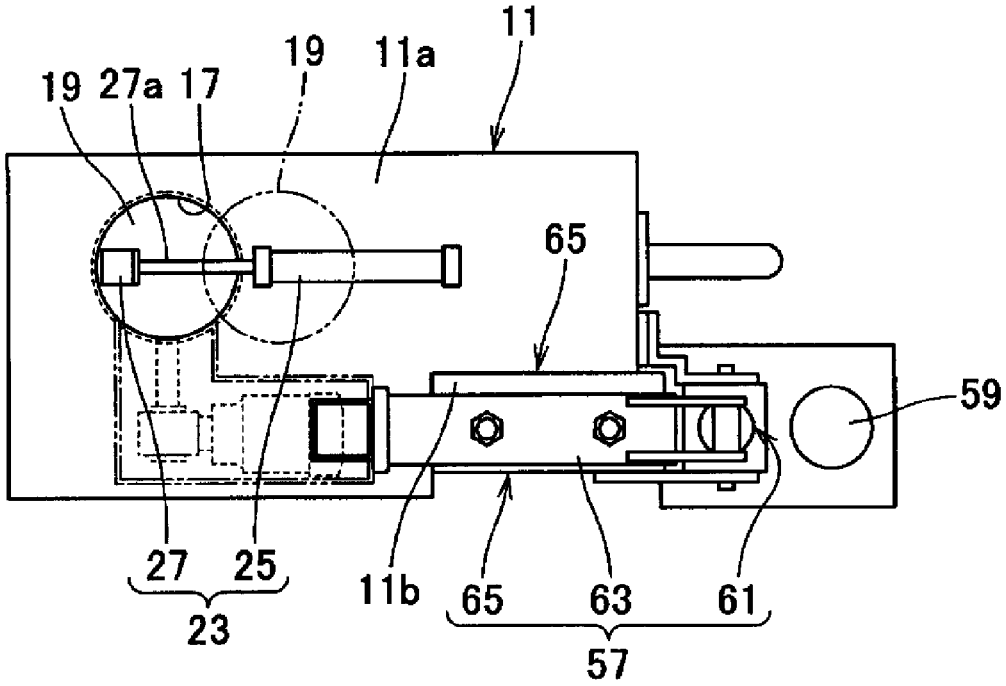
FIG. 4 shows a schematic plane view of the machine for blasting the abrasives of FIG. 2.

An embodiment of the machine for blasting abrasives (a machine for shot peening) of the present invention is illustrated in FIGS. 2 and 3.

The machine for blasting abrasives basically comprises a chamber 11 for processing, a nozzle 13 for shooting abrasives (shots) S onto a work W, and a jig 15 for holding the work W. The nozzle 13 is located within the chamber 11. The height of the jig 15 is adjustable so as to keep the work W in the position to face the nozzle 13. A gateway 17 for the work is formed in the chamber 11. It is opened and closed by a door 19. This machine for blasting abrasives has the same structure as a prior-art machine for blasting abrasives.

The gateway 17 is formed in the ceiling 11*a* of the chamber 11. The gateway 17 is located at a position corresponding to the jig 15 that is linearly moving up and down. Its size enables the work W to protrude from the chamber 11 by means of the jig 15. The door 19 is provided within the chamber 11, specifically at a height just under the ceiling 11*a*, so as to linearly move up and down to seal the gateway 17 and to horizontally (laterally) move to create a vacant plane on the gateway 17 for passing the work through it. A sealing material 21 is provided on the rim of the gateway 17. The sealing material 21 is typically made of wear-resistant rubber or a closed-cell porous sponge.

The gateway 17 has a circular shape with its center line being aligned with that of the jig 15. If the work W protrudes from the chamber 11, the center line of the gateway 17 may deviate from the center line of the jig 15.

An actuator 23 for opening and closing the door is provided adjacent the gateway 17 on the ceiling 11*a*. The actuator 23 comprises a lateral cylinder 25 for horizontal motion and a vertical cylinder 27 for vertical motion. The vertical cylinder 27 is fixed to the tip of the piston rod 25*a* of the lateral cylinder 25.

The tip of the piston rod 27*a* of the vertical cylinder 27 is connected to the door 19 that has a shape of a dome. The position for the connection deviates from the center of the dome and toward the direction that the piston rod 25*a* of the lateral cylinder 25 extends.

The lateral cylinder 25 is configured to have the front dead point of the piston rod 25*a* located at the position where it can close the door and the back dead point at the position where it can open it.

The vertical cylinder 27 is configured to have the back dead point (upper dead point) of the piston rod 27*a* located at the position to have the door press the surrounding sealing material 21 at the rim of the gateway 17 and the front dead point (lower dead point) located at the position to have the door separate from the surrounding sealing material 21 so as to be able to slide under the ceiling 11*a*.

Figure 5:
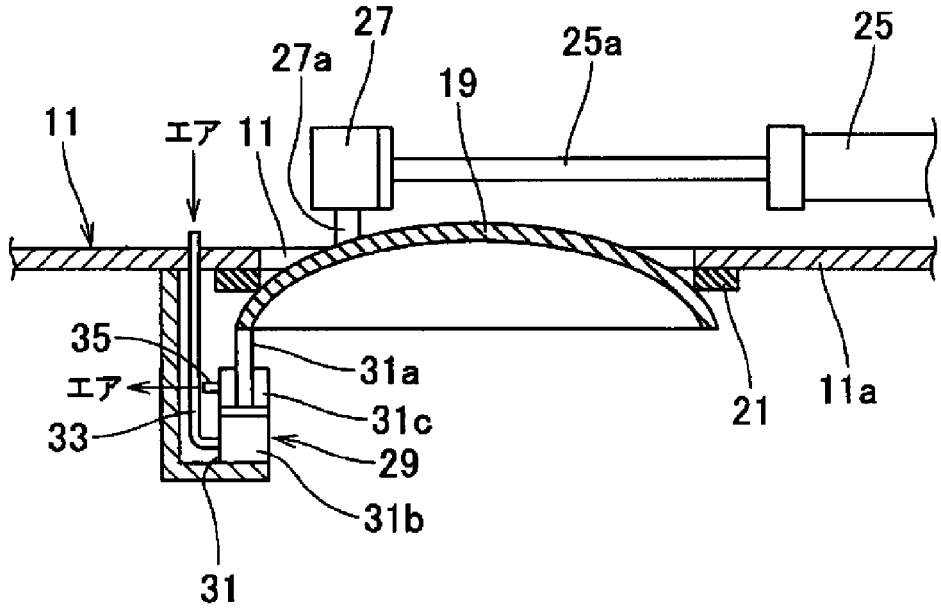
FIG. 5(A) illustrates a sectional view of the main section of the auxiliary mechanism for shutting the door that is used in the present invention.
FIG. 5(B) illustrates a positional relationship between the cylinder and the door that are used in the mechanism of FIG. 5 (A).
Figure 5:
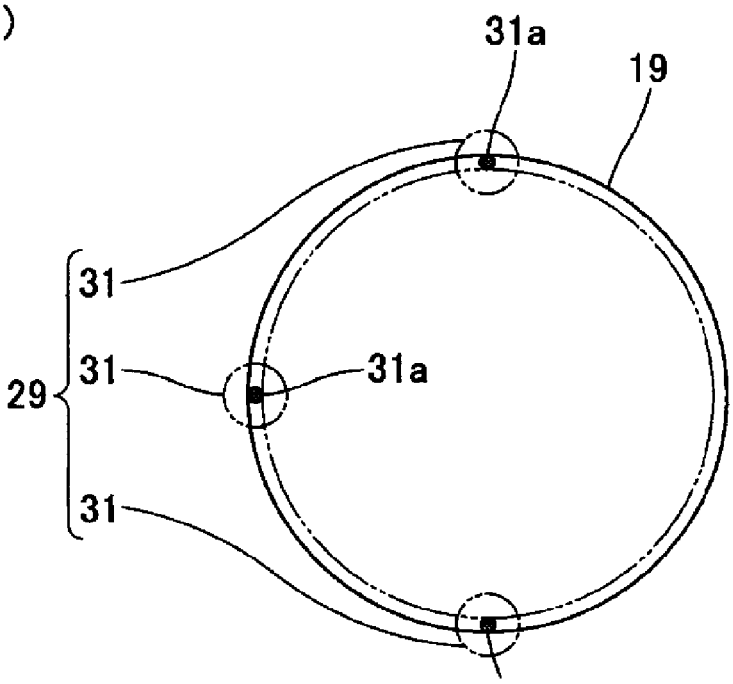

The machine in this embodiment preferably comprises an auxiliary unit 29 for shutting the door, as shown in FIG. 5. The auxiliary unit 29 for shutting the door comprises a plurality (three in FIG. 5) of auxiliary cylinders 31 for pressing the lower surface of the periphery of the door 19. The auxiliary cylinders 31 press the lower surface of the periphery of the door 19 by means of the tips of the piston rods 31*a*. A flexible communication tube 33 to communicate with the outside of the chamber 11 (the ambient side) is connected to each chamber at the side of the piston rod, i.e., a compressing chamber 31*b* that pushes out the piston rod 31*a*. A vent 35 to communicate with the inside of the chamber 11 is formed at the chamber at the reverse side, i.e., the back-pressure chamber 31*c*. By so constructing the machine for blasting the abrasives, when the pressure in the chamber 11 is as that in a vacuum (below the atmospheric pressure), each piston rod 31*a* functions as an aid to press the door 19, to close it.

Figure 8:
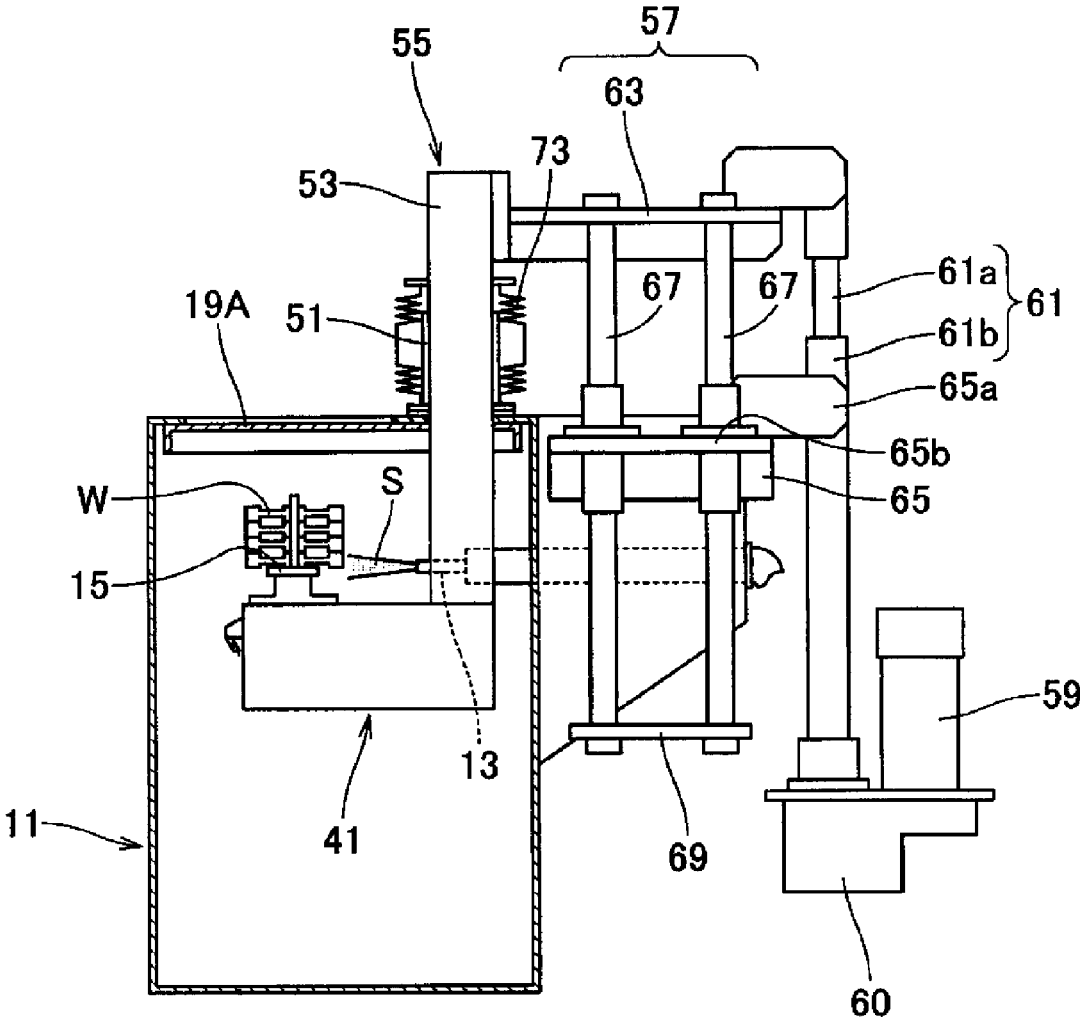
FIG. 8 shows a schematic sectional front view of a variation of the machine for blasting abrasives (a machine for shot peening) according to the present invention.

Though the door 19 may be shaped as a flat plate as shown in FIG. 8 (the door 19A in FIG. 8), it is preferably shaped as a dome (hemisphere) as illustrated in FIG. 5, because a door with such a shape can easily and uniformly contact the surface of the sealing material and ensure a high sealing (contacting) ability. Thus dust can be reliably prevented from leaking from the chamber 11 for processing even if the pressure in the chamber 11 reaches the atmospheric pressure or higher.

Figure 6:
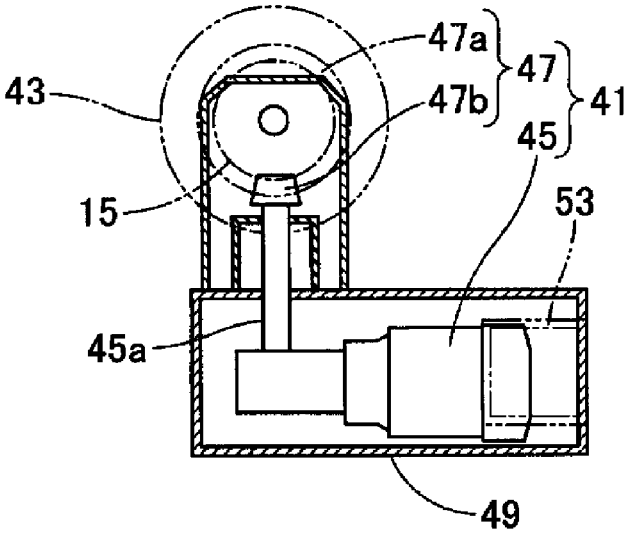
FIG. 6 illustrates a sectional plane view of a driving mechanism for rotating a jig for holding a work.
Figure 7:
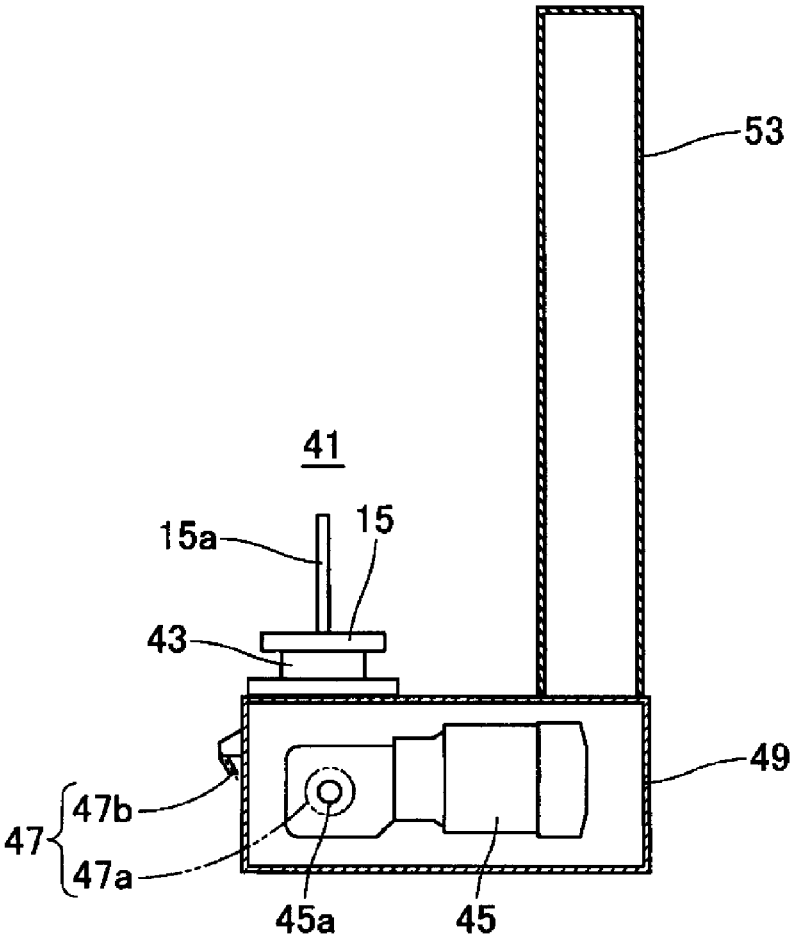
FIG. 7 illustrates a sectional elevation view of the driving mechanism for rotating the jig for holding the work of FIG. 6.

The jig 15 for holding the work that comprises a rod 15*a* for placing the work on the rod 15*a* is attached to a driving unit 41 for rotating the jig, as shown in FIGS. 6 and 7. The driving unit 41 for rotating the jig comprises a rotating table 43 on which the jig 15 is set, a rotating motor 45 that is a driving source for the rotating table 43, and a bevel-gear system 47 to transfer the output from the rotating motor 45 to the rotating table 43 by changing the axes of rotation. The bevel-gear system 47 comprises a bevel spur-gear 47*a* that is formed under the rotating table 43 and a bevel pinion 47*b* that is fixed at the tip of the output shaft 45*a* of the rotating motor 45.

The driving unit 41 is held within, and is covered by, a holding arm 49 that functions to prevent dust from entering the arm 49. The arm 49 is a square tube with an L shape in a horizontal plane.

The root of the holding arm 49 is connected to the lower end of a vertically-moving column (square pipe) 53 that is supported by a sleeve 51 on the ceiling 11*a* of the machine.

In this embodiment, one driving source, i.e., an actuator for moving the work up and down (called a "vertically-moving actuator" below) 57 can drive both a mechanism for adjusting the height of the work and a mechanism for causing the work to protrude.

The vertically-moving actuator 57 comprises the vertically-moving column 53, to the lower end of which the driving actuator 41 for rotating the jig is attached, a vertically-moving cylinder 61, which is a driving source, and a connecting arm 63, which connects the piston rod 61*a* of the vertically-moving cylinder 61 to the upper end of the vertically-moving column 53.

The vertically-moving cylinder 61 is an electric cylinder that is driven by a servomotor (electric motor) 59 via gears. The number 60 in the drawings denotes a gear case. The source to drive the vertically-moving actuator 57 is not limited to an electric cylinder, but may be a hydraulic cylinder, a pneumatic cylinder, or a scissor lift driven by a chain.

The piston rod 61*a*, which is the moving part of the vertically-moving cylinder 61, and the upper end of the vertically-moving column 53, are connected by the connecting arm 63. Thus they move up and down in an integrated manner.

The vertically-moving actuator 57 is supported by a frame (mounting) 65 that is fixed to the sidewall 11*b* of the chamber 11 as follows:

The cylinder portion 61*b* of the vertically-moving cylinder 61 is clamped by brackets 65*a*, 65*a* at the front side of the frame 65. The brackets 65*a*, 65*a* are formed on the sidewall of the chamber 11.

The connecting arm 63 is equipped with a pair of guide rods 67, 67 that extend downward. The lower ends of the guide rods 67, 67 are connected by a connecting plate 69. They are guided by a pair of fixed guiding tubes 71, 71 that are attached to a horizontal supporting plate 65*b* of the frame 65 to enable the vertically-moving column 53 to smoothly move up and down.

A portion of the vertically-moving column 53 corresponding to the sleeve 51 is covered with a bellows-type dust boot 73. It is used for preventing dust that is generated in the chamber 11 or fine shots from leaking out of the chamber 11.

Each cylinder may be a pneumatic cylinder, a hydraulic cylinder, or an electric cylinder. An electric cylinder is preferable because no piping that is generally used for a pneumatic cylinder or a hydraulic cylinder is required.

Next, the usage of the machine for blasting abrasives (machine for shot peening) of the present invention will be described.

The machine for blasting abrasives may be used not only for shot peening, but also for shot blasting. Works that can be processed by shot peening include a variety of gears, a variety of shafts, springs, parts of engines, turbine engines for aircraft, and machine tools. Works that can be processed by shot blasting with a nozzle as described in the above embodiment are the same as those for shot peening. For shot blasting that is energized by centrifugal forces (impellers), the works to be processed include cast products that are subject to sand stripping and wrought products and products made by performing work on a plate that are subject to scaling or burring.

First, the gateway 17 for the work is opened by activating the actuator 23 for opening and closing the door. That is, the door 19 is lowered by activating the vertical cylinder 27. Then, by activating the lateral cylinder 25, the door 19 is moved to the position under the ceiling 11*a* that is adjacent to the gateway 17. Thus the door 19 is opened. By doing so the gateway 17 is then in a condition that a work can pass through it.

The jig 15 is elevated by activating the vertically-moving actuator 57 to cause it to protrude from the ceiling 11*a* of the machine for blasting abrasives. In this condition the work W is placed on the jig 15. Then the vertically-moving actuator is again activated to lower and adjust the work W to the height that is predetermined for the process.

Then the door 19 is closed by activating the actuator 23 for opening and closing the door. That is, the door is laterally moved by the lateral cylinder 25 to the position corresponding to the gateway 17. Then the door 19 is elevated by the vertical cylinder 27 to the position where it presses the sealing material 21 at the rim of the gateway 17.

In that condition, the abrasives S are blasted from the nozzle 13 onto the work W. If required, the work W is rotated by activating the rotating motor 45.

When blasting the abrasives, a dust collector (not shown) that is connected to the chamber 11 is generally used to retrieve the abrasives or collect dust. Thus the pressure in the chamber 11 becomes that of a vacuum.

In this embodiment, the lower surface of the periphery of the door 19 is pressed by the piston rod 31*a* of the auxiliary cylinder 31 for pressing when the piston rod 31*a* is elevated. This is caused by air that is introduced from the outside of the chamber 11 into the compressing chamber 31*b* of the auxiliary cylinder 31 and air that escapes from the back-pressure chamber 31*c*, since the pressure in the chamber 11 is that of a vacuum because of the operation of the dust collector as described above (see FIG. 5).

If a plurality of portions or a wide area in the vertical direction is to be processed, the work W (the jig 15 for holding the work) is moved up and down in a discontinuous or a continuous manner by the vertically-moving actuator 57.

While the work W is processed, the gateway 17 is located in the ceiling 11*a* of the chamber 11. Thus, the abrasives that fly in all directions during the process fall due to their own weight. Therefore the leakage of the abrasives out of the chamber is greatly reduced in compared to if the gateway 17 were to be located in the sidewall.

Further, if the gateway for the work were to be provided in the sidewall, the gateway would have to be enlarged so that a tall work could be passed through it. However, in the present invention, when the gateway 17 is provided in the ceiling 11*a*, the gateway 17 is formed as a circle by considering only the diameter of the work. Thus the perimeter of the gateway 17, i.e., the length to be sealed, can be greatly shortened. Because of this, the leakage of the abrasives during the process can be reduced.

After processing the work W in the way described above, the dust collector is stopped, and the door 19 is opened by activating the actuator 23 for opening and closing the door as described above.

At this time, the vertically-moving actuator 57 is activated to move the work out of the chamber 11 and through the ceiling 11*a* (gateway 17). Thus the work (product) is taken out of the jig 15.

When taking out the work W, the abrasives that have adhered to the work W may fall off it. Since the abrasives fall due to their own weight, they seldom fall outside of the gateway 17.

A variation from the above-described embodiment is illustrated in FIG. 8. In the variation, the door 19A is shaped as a rectangular plate, not as a dome. The function and effects of the variation are the same as those of the above-described embodiment except for those caused by the door 19A. Thus the elements other than the door 19A are denoted by the same numbers. So the descriptions of those elements are omitted.

In the above-described embodiment, the driving source for moving the jig 15 up and down to protrude the work from the chamber 11 and the driving source for adjusting the height of the work during the process are the same source. However, they may be separate sources. Further, the work W may be placed on, or taken out of, the jig 15 within the chamber 11.

In the present invention, the height of the nozzle 13 relative to that of the work W may be adjusted by just moving the nozzle 13 up and down while the height of the jig 15 is fixed.

Figure 9:
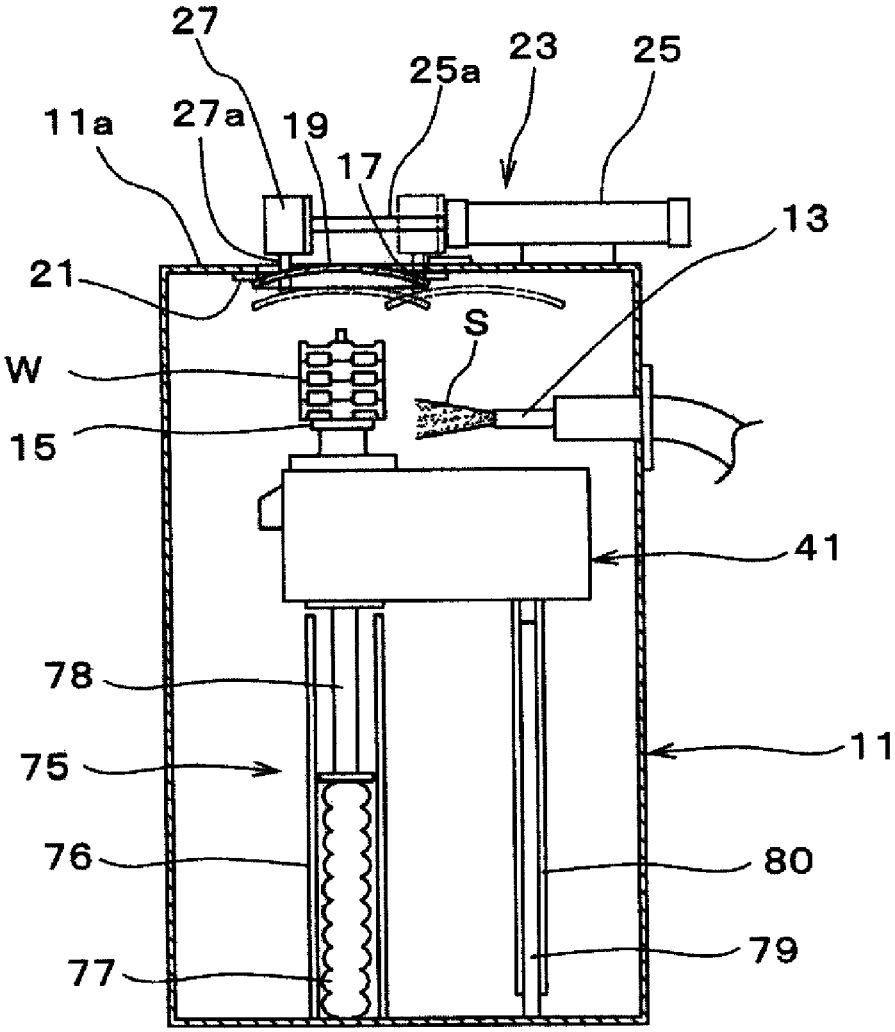
FIG. 9 shows a schematic sectional front view of another embodiment of the machine for abrasive processing (a machine for shot peening) according to the present invention, when a work is processed.
Figure 10:
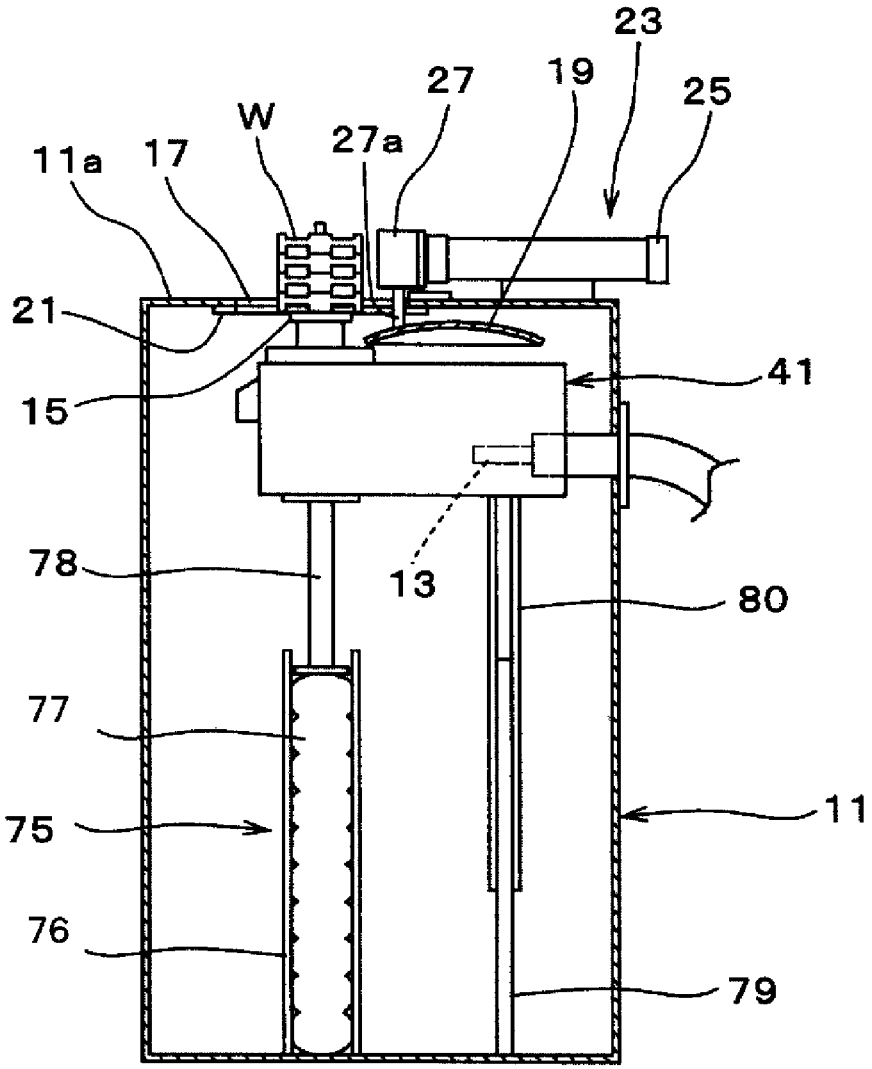
FIG. 10 shows a schematic sectional front view of the machine for blasting abrasives of FIG. 9, when a work is taken out.

Next, another embodiment of the machine for blasting abrasives (machine for shot peening) of the present invention is described with reference to FIGS. 9 and 10. In the machine for blasting abrasives in FIGS. 9 and 10, the way for moving the driving unit 41 up and down to which the jig 15 is attached differs from that of the machine for blasting abrasives in FIGS. 2 and 3.

Figure 11:
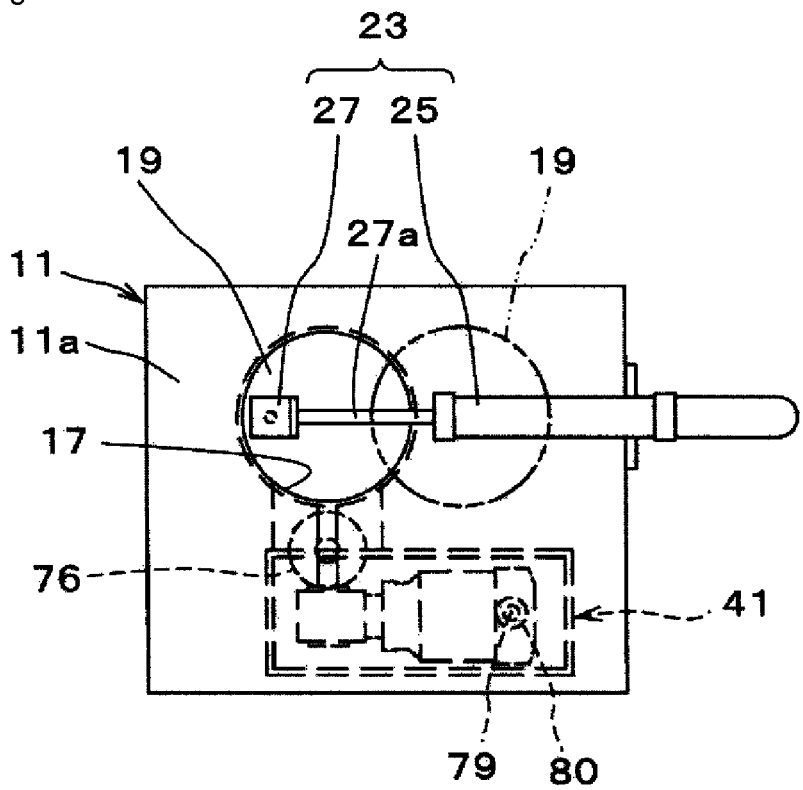
FIG. 11 shows a schematic plane view of the machine for blasting abrasives of FIG. 10.
Figure 12:
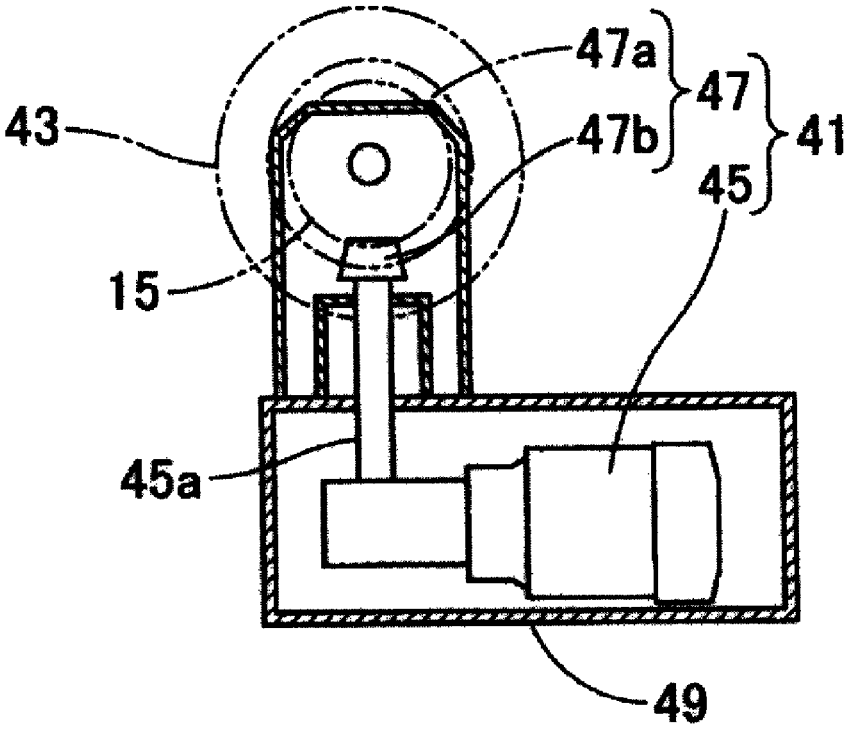
FIG. 12 illustrates a sectional plane view of a driving mechanism for rotating a jig for holding a work.
Figure 13:
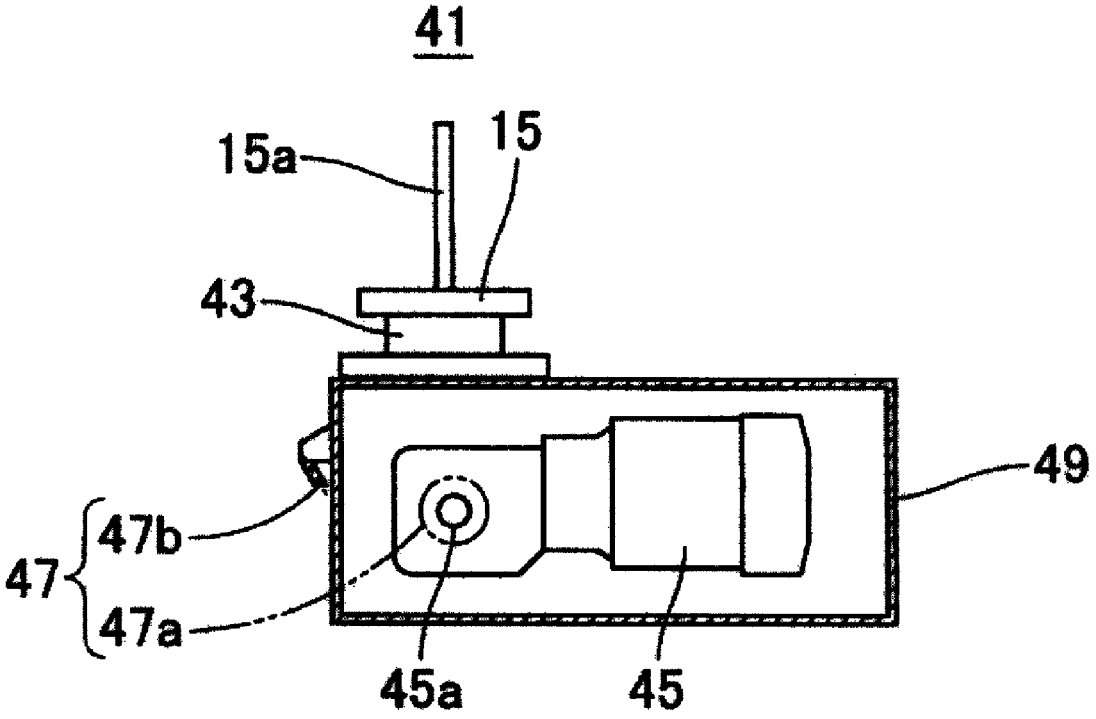
FIG. 13 illustrates a sectional elevation view of the driving mechanism for rotating the jig for holding a work of FIG. 12.

The jig 15 for holding the work that comprises a rod 15*a* for placing the work on the rod 15*a* is attached to a driving unit 41 for rotating the jig, as shown in FIGS. 11 and 12. The driving unit 41 for rotating the jig comprises a rotating table 43 on which the jig 15 is set, a rotating motor 45 that is a driving source for the rotating table 43, and a bevel-gear system 47 to transfer the output from the rotating motor 45 to the rotating table 43 by changing the axes of rotation. The bevel-gear system 47 comprises a bevel spur-gear 47*a* that is formed under the rotating table 43 and a bevel pinion 47*b* that is fixed at the tip of the output shaft 45*a* of the rotating motor 45.

The driving unit 41 is held within, and is covered by, a holding arm 49 that functions to prevent dust from entering the arm 49. The arm 49 is a square tube with an L shape in a horizontal plane.

The height and position of the driving unit 41 to which the jig 15 is attached can be adjusted by a vertically-moving unit 75. The vertically-moving unit 75 comprises a cylindrical supporting member 76 that stands on the floor of the chamber 11 at a position below the left side in FIGS. 9 and 10 of the driving unit 41 for rotating the jig. It also comprises an extending and contracting member 77 that is inserted into the supporting member 76 and is constructed like a bellows so as to extend or contract in the vertical direction by having compressed air supplied to or discharged from it like a balloon. It also comprises a vertically-moving member 78 that is suspended from the underside of the driving unit 41 for rotating the jig and loosely and slidably held by the supporting member 76. The vertically-moving member 78 has a circular disk that contacts the upper end of the extending and contracting member 77. The vertically-moving unit 75 also comprises a guiding rod 79 that stands on the floor of the chamber 11 at a position below the right side in FIGS. 9 and 10 of the driving unit 41 for rotating the jig. It also comprises a guiding sheath 80 that is suspended from the underside of the driving unit 41 for rotating the jig and slidably attached around the guiding rod 79. The height of the vertically-moving unit 75 is adjusted by supplying and discharging compressed air to and from the extending and contracting member 77. The guiding rod 79 and the guiding sheath 80 function as a guide to stabilize the up and down motion of the driving unit 41 for rotating the jig. Thus the guiding rod 79 and the guiding sheath 80 are preferably disposed, on the underside of the driving unit 41 for rotating the jig, at a position symmetrical to the position of the supporting member 76, the extending and contracting member 77, and the vertically-moving member 78. The guiding rod 79 and the guiding sheath 80 are not necessarily provided. The guiding rod 79 may be suspended from the underside of the driving unit 41 for rotating the jig and the guiding sheath 80 may stand on the floor of the chamber 11. Further, the supporting member 76, the extending and contracting member 77, and the vertically-moving member 78, or the guiding rod 79 and the guiding sheath 80, are not limited to one set. Though in this embodiment compressed air is supplied to, and discharged from, the extending and contracting member 77, the fluid that is supplied to, and discharged from, the extending and contracting member 77 may be a liquid.

The door 19 is opened to enable the work W to pass through the gateway 17. The door 19 is opened and closed in the same way as that shown in FIGS. 2 and 3.

After opening the door 19, compressed air is supplied to the extending and contracting member 77 of the vertically-moving unit 75. The jig 15 is elevated to protrude out of the ceiling 11*a* of the machine for blasting abrasives. In such a condition the work W is set on the jig 15. Then the compressed air is discharged from the extending and contracting member 77 of the vertically-moving unit 75 to lower and adjust the work W to the position that is predetermined for the process.

Then the door 19 is closed. The abrasives S are blasted from the nozzle 13 onto the work W. The way to blast the abrasives S is the same as that shown in FIGS. 2 and 3.

If a plurality of portions or a wide area in the vertical direction is to be processed, the work W (the jig 15) is moved up and down by the vertically-moving unit 75 in a discontinuous or a continuous manner.

When the process (peening or blasting) of the work W is completed, the dust collector is stopped. Then the door 19 is opened by activating the unit for opening and closing the door in the same way as described above.

At this time, compressed air is supplied to the extending and contracting member 77 of the vertically-moving unit 75 to move the work out of the chamber 11 and through the ceiling 11*a* (gateway 17). Thus the work (product) is taken out of the jig 15.

When taking out the work W, the abrasives that have adhered to the work W may fall off it. Since the abrasives fall due to their own weight, they seldom fall outside the gateway 17.

In the above-described embodiments, the driving source for vertically-moving the jig for placing a work on it and taking it out and the driving source for adjusting the height of the work during the process, are the same source. However, they may be different sources. Further, the work W may be placed on, or taken out of, the jig 15 within the chamber 11.

The invention claimed is:

1. A machine for blasting abrasives comprising:

a chamber for processing;

a nozzle for shooting the abrasives onto a work, the nozzle being located within the chamber; and a jig for holding the work in a position facing the nozzle;

wherein a gateway for the work being formed in the chamber is opened and closed by a door;

characterized in that the gateway is formed in the ceiling of the chamber; and in that the door is provided within the chamber so as to be able to linearly move up and down to contact, and separate from, the gateway from inside the chamber, and, in that, while the door is separating from the gateway, the door horizontally moves to create a vacant plane on the gateway for passing the work.

2. A machine for blasting abrasives comprising:

a chamber for processing;

a nozzle for shooting the abrasives onto a work, the nozzle being located within the chamber; and a jig for holding the work in a position facing the nozzle, the jig being moved up and down to adjust a height;

wherein a gateway for the work that is formed in the chamber is opened and closed by a door;

characterized in that the gateway is formed in a ceiling of the chamber at a position corresponding to the jig that is linearly moving up and down, a size of the gateway enabling the jig to cause the work to protrude from the chamber; and in that the door is provided within the chamber so as to be able to linearly move up and down to contact, and separate from, the gateway from inside the chamber, and, while the door is separating from the gateway, the door horizontally moves to create a vacant plane on the gateway for passing the work.

3. The machine for blasting abrasives of claim 1 or 2, wherein the door is shaped as a dome.

4. The machine for blasting abrasives of claim 3, further comprising:

an auxiliary mechanism for shutting the door being operated when a pressure in the chamber is that of a vacuum;

wherein the auxiliary mechanism for shutting the door is configured so that a plurality of cylinders are provided at positions corresponding to a lower surface of a periphery of the door, so that tips of piston rods of the cylinders press the lower surface of the periphery of the door, so that communication tubes that connect respective compressing chambers of the cylinders to outside the chamber so that the compressing chambers push out the piston rods, and so that vents are formed in back-pressure chambers of the cylinders to communicate with the chamber.

5. The machine for blasting abrasives of claim 1 or 2, wherein the jig is attached to a driving unit for rotating the jig, and wherein the driving unit for rotating the jig is vertically moved by a vertically-moving unit, the vertically-moving unit comprising:

a cylindrical supporting member standing on a floor of the chamber under a side of the driving unit for rotating the jig;

an extending and contracting member being provided within the supporting member, the extending and contracting member being shaped like a bellows to vertically extend or contract by having fluid supplied to or discharged from the supporting member; and a circular disk being suspended from an underside of the driving unit for rotating the jig and slidably attached to the supporting member, the circular disk contacting an upper end of the extending and contracting member.

* * * * *